United States Patent [19]

Kourogi

[11] Patent Number: 4,917,565

[45] Date of Patent: Apr. 17, 1990

[54] APPARATUS FOR CONTROLLING POSTURE OF FRONT LOADER

[75] Inventor: Isao Kourogi, Osaka, Japan

[73] Assignee: Kubota Ltd., Osaka, Japan

[21] Appl. No.: 242,165

[22] Filed: Sep. 8, 1988

[30] Foreign Application Priority Data

Sep. 10, 1987 [JP] Japan ..... 62-226995
Sep. 10, 1987 [JP] Japan ..... 62-226996

[51] Int. Cl.[4] ..... F15B 13/00; E02F 3/00

[52] U.S. Cl. ..... 414/701; 414/722; 414/697; 74/471 XY

[58] Field of Search ..... 74/471 XY; 414/701, 414/697, 698, 699, 700, 722

[56] References Cited

U.S. PATENT DOCUMENTS

| | | | |
|---|---|---|---|
| 3,155,253 | 11/1964 | Pilch | 414/701 |
| 3,161,307 | 12/1964 | Schick et al. | 414/701 |
| 3,432,057 | 3/1969 | Goth | 414/701 |
| 3,522,897 | 8/1970 | Freedy | 414/701 |
| 3,642,159 | 2/1972 | Askins | 414/701 |
| 3,698,583 | 10/1972 | Shore | 414/701 |
| 3,738,522 | 6/1973 | Cecchi | 414/701 |
| 3,823,647 | 7/1974 | Campbell et al. | 414/701 X |
| 3,929,245 | 12/1975 | Inoue | 414/701 |
| 4,825,568 | 5/1989 | Kawamura et al. | 414/722 X |

FOREIGN PATENT DOCUMENTS 61-221422 10/1986 Japan .

*Primary Examiner*—Frank E. Werner
*Assistant Examiner*—James T. Eller, Jr.

[57] ABSTRACT

The posture of a front loader attached to a vechicle body is controllable by an apparatus which comprises an engaging portion provided on a control lever, an engageable member pivoted to a fixed member on the vehicle body and releasably engageable with the engaging portion when the control lever is positioned for lowering the boom of the loader and for moving the work implement of the loader for scooping, an implement sensor for detecting whether the angle between the implement and the boom is an angle which provides contact of a work implement bottom surface parallel with horizontal ground, and a release interlocking mechanism operatively connected to the sensor and to the engageable member for moving the engageable member to a released position where the member is not engageable with the engaging portion upon the sensor detecting that the work implement is at the angle.

16 Claims, 7 Drawing Sheets

APPARATUS FOR CONTROLLING POSTURE OF FRONT LOADER

FIELD OF THE INVENTION AND RELATED ART STATEMENT

The present invention relates to an apparatus for controlling the posture of a front loader attached to a vehicle body.

Front loaders are known which comprises a mast secured to a vehicle body, a boom supported by the mast and liftable by a boom cylinder, a work implement rotatably supported by the forward end of the boom and movable by an implement cylinder for scooping and dumping, a boom control valve for operating the boom cylinder, an implement control valve for operating the implement cylinder and a single control lever for operating the two control valves independently of each other and also at the same time. The front loader is used for scooping up, transporting, loading or dumping sand, earth, grass or the like.

Sand, earth or the like can be scooped up with the front loader conveniently by advancing the loader immediately after the work implement is placed on the ground, if the implement can be placed on the ground horizontally after dumping. However, it is not easy for the operator to intentionally place the work implement in the horizontal position in contact with the ground.

Accordingly, Unexamined Japanese Patent Publication No. SHO 61-221422 proposes a control apparatus which comprises electromagnetic valves serving as the respective control valves and adapted to be electrically given a boom lowering signal and an implement upward turning signal (scooping direction signal), such that when it is detected that the implement is upwardly turned (scooping movement) to an angle at which it contacts the horizontal ground during the descent, by detecting the angle of the boom with respect to the work implement, the implement control valve is automatically returned to its neutral position.

Nevertheless, the proposed apparatus requires expensive electric components such as two sensors and electromagnetic valves and encounters difficulties in operating with improved reliability.

Especially because the loader is subjected to intense vibrations and impacts involved in civil engineering work, the electric sensors have the problem of many errors and early malfunctions.

Further when operating the boom and the work implement, the operator must intentionally hold the control lever positioned for lowering the boom and for implement scooping movement. Thus, there is the problem that great skill is needed for the operator to retract the vehicle while operating the loader.

OBJECTS AND SUMMARY OF THE INVENTION

The present invention has been accomplished to overcome the foregoing problems heretofore encountered.

A first object of the invention is to provide an apparatus wherein when a control lever is positioned for lowering the boom and moving the work implement for scooping, an engaging portion engages with an engagable member to lock the control lever in the position so as to obviate the possible trouble when the operator leaves his hand from the control lever so positioned.

A second object of the invention is to provide an apparatus of the type described which comprises implement sensor means for detecting whether the angle between the work implement and the boom is an angle of contact with the horizontal ground while the implement is being moved in the scooping direction during the descent of the boom after a dumping movement of the implement, so that when the contact angle is detected, the engagable member is moved to a released position to stop the implement at the contact angle and enable the implement to immediately scoop up sand, earth or the like.

A third object of the invention is to give a vibration to the work implement when the implement dumps earth, sand or like material with the boom in its lifted position to eliminate the likelihood that the implement will subsequently scoop up another portion of material with some of the material remaining in or adhering to the implement.

A fourth object of the invention is to provide an apparatus of the type described adapted to stop the boom when the boom is lowered to a transport position, so that the work implement will be positioned at the contact angle, the control lever being automatically unlockable when the boom is positioned at a level lower than the transport position and when the work implement is positioned at the contact angle.

A fifth object of the invention is to make it possible to use a boom control valve and an implement control valve which are manually operable and inexpensive.

To fulfill the first, second and fifth objects, the present invention provides an apparatus which is first characterized in that it comprises an engaging portion provided on a control lever, an engagable member provided on a fixed member on a vehicle body and releasably engagable with the engaging portion when the control lever is positioned for lowering the boom of a front loader and for moving the work implement of the loader for scooping, implement sensor means for detecting whether the angle between the work implement and the boom is an angle of contact with the horizontal ground, or in other words, whether this angle provides a horizontal work implement, and release interlocking means operatively connected to the implement sensor means and to the engagable member for moving the engagable member to a released position where the engagable member is not engagable with the engaging portion upon the implement sensor means detecting that the work implement is at the angle of contact.

To fulfill the first to third and fifth objects, the apparatus of the invention, having the first feature, is further characterized in that it comprises another implement sensor means for detecting whether the angle between the work implement and the boom is a dumping angle at which the implement almost completes its dumping movement, and release interlocking means operatively connected to the implement sensor means and to the engagable member for moving this member to a released position where the engagable member is not engagable with the engaging portion upon the respective sensor means detecting the contact angle of the implement and the dumping angle thereof.

To fulfill the first to fifth objects, the apparatus of the invention, having the first and second features, further comprises a stopper provided on the fixed member and movable for a change-over to restrain the engaging portion in engagement with the engagable member from moving toward the neutral position of the control lever, boom sensor means for detecting whether the boom is in the transport position, and release interlocking means for releasing the stopper when the boom is in the transport position and for causing the stopper to move the engagable member to the released position where the member is not engagable with the engaging portion when the boom is positioned below the transport position.

BRIEF DESCRIPTION OF THE DRAWINGS

The drawings show an embodiment of the present invention.

DESCRIPTION OF THE PREFERRED EMBODIMENT

Figure 4:
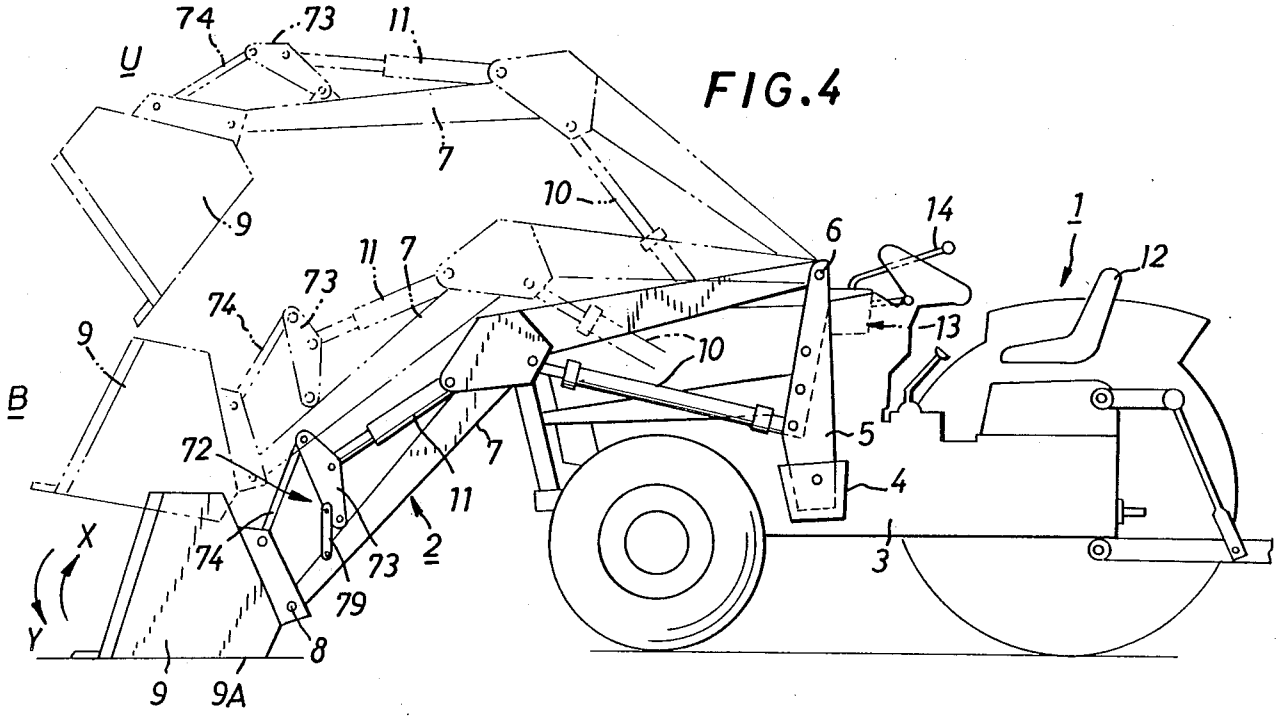
FIG. 4 is a side elevation showing a front loader as attached to a tractor.

With reference to FIG. 4, a front loader 2 of the bucket type is attached to the front portion of a wheeled tractor 1. The body 3 of the tractor has a pair of mounts 4 on its opposite sides. A mast 5 is removably secured to each mount 4. A pair of opposed booms 7 are supported by a pivot 6 on the upper ends of the masts 5 and movable upward and downward. A work implement 9 is supported by a pivot 8 to the forward ends of the booms 7.

Each of the booms 7 is bent at a lengthwise intermediate portion thereof. The rear portion from the bent portion to the mast 5 and the front portion from the bent portion to the work implement 9 are substantially straight.

In the state indicated in solid line in FIG. 4, the implement 9 has an opening at its front portion. Besides the bucket illustrated, a fork, grader or backhoe bucket or the like is usable as the work implement.

A boom cylinder 10 is connected between the intermediate portion of the boom 7 and the lower portion of the mast 5 for lifting and lowering the boom 7. An implement cylinder 11 is connected between the intermediate portion of the boom 7 and the work implement 9 for moving the implement 9 for scooping and dumping.

A control apparatus 13 for the front loader 2 is disposed at a position accessible by the operator in the seat 12 of the tractor 1.

Figure 1:
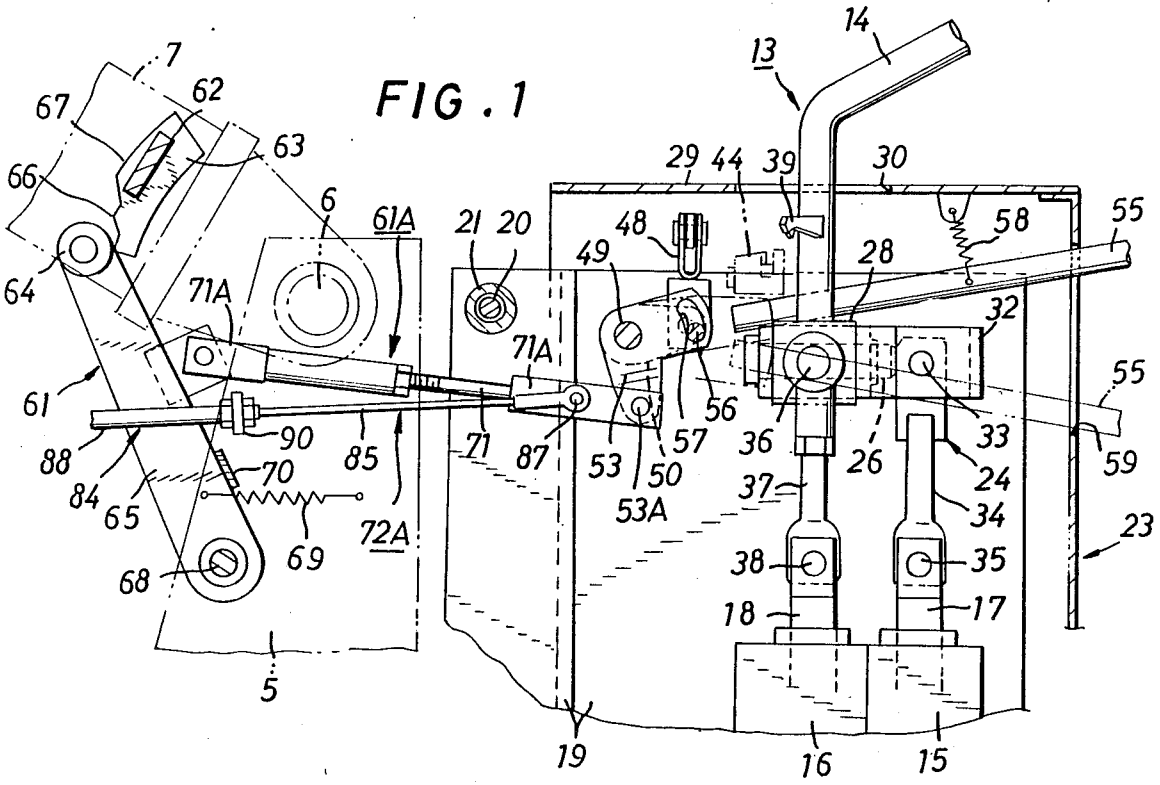
FIG. 1 is a side elevation in section showing a control apparatus.
Figure 2:
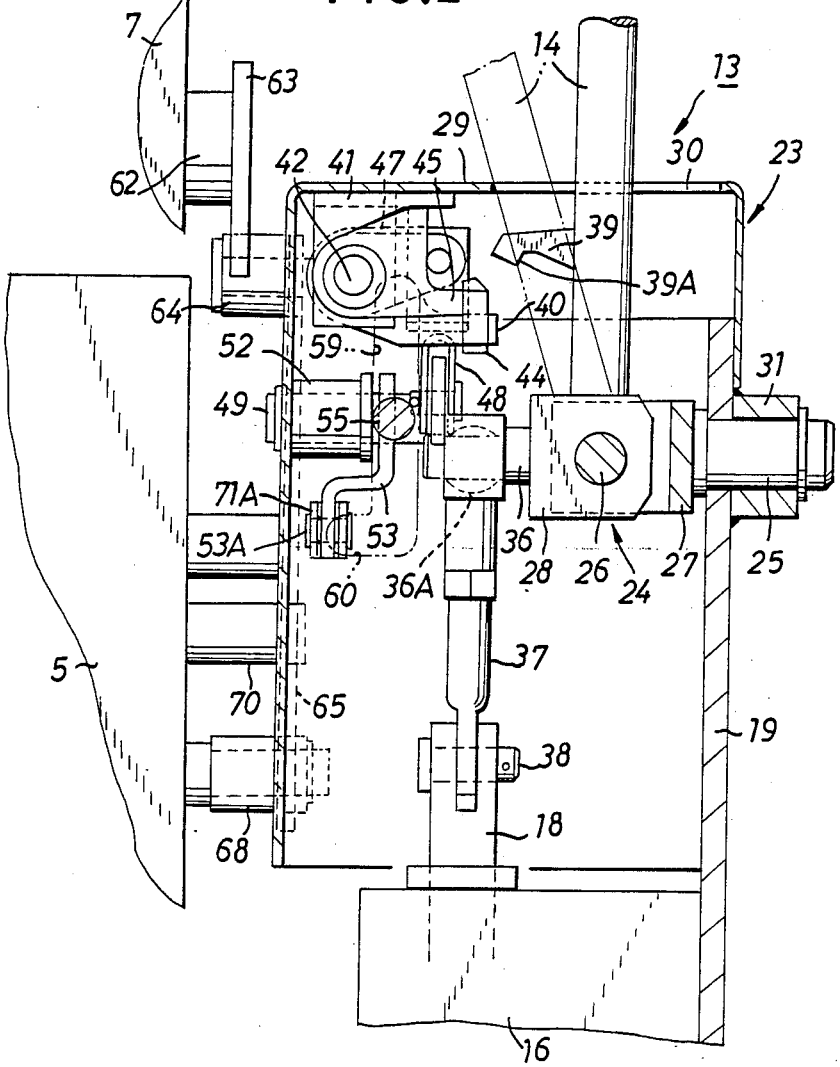
FIG. 2 is a rear view in section showing the same.
Figure 3:
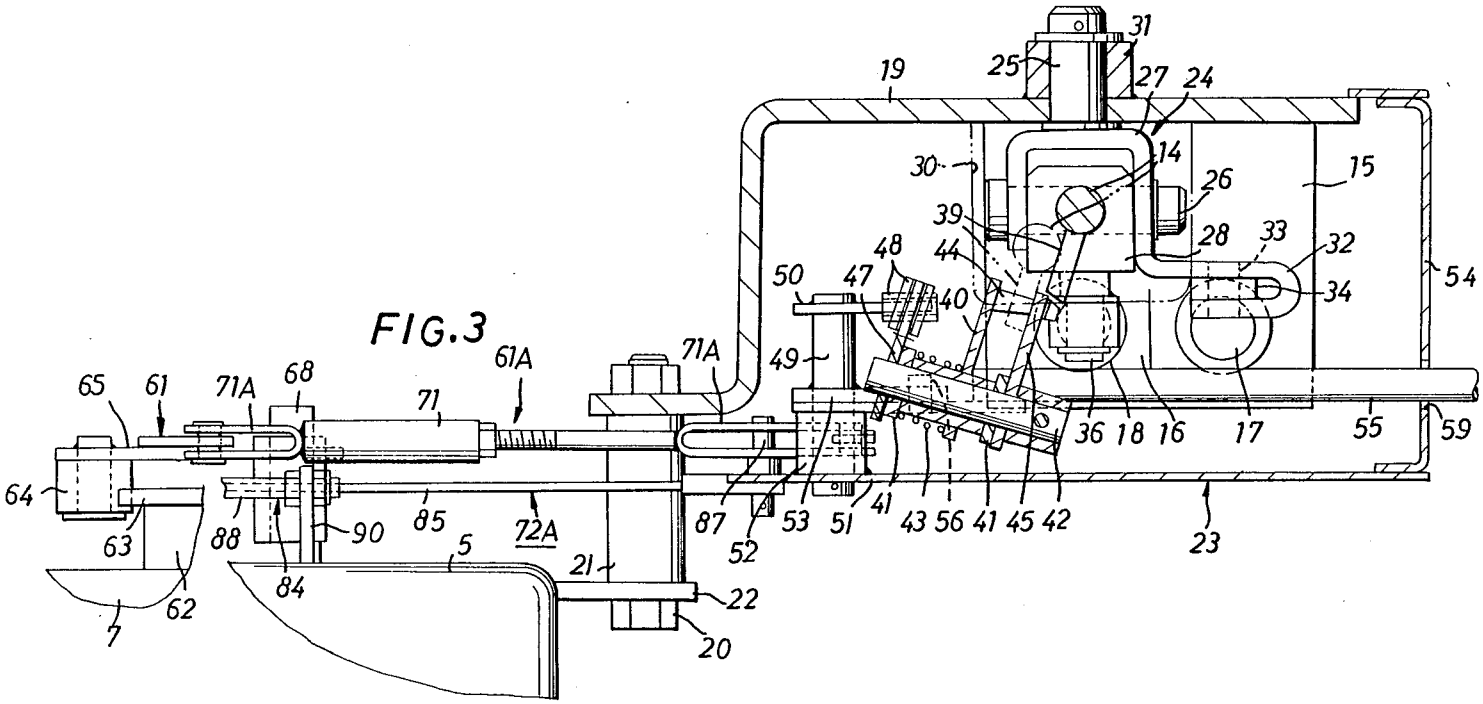
FIG. 3 is a plan view in section of the same.

The control apparatus 13 is attached to the right mast 5 and has a single control lever 14. FIGS. 1 to 3 show the construction of the control apparatus 13.

With reference to FIGS. 1 to 3, the control apparatus comprises a boom control valve 15 for controlling the boom cylinder 10, and an implement control valve 16 for controlling the implement cylinder 11. The control valves 15, 16, each in the form of a spool-type changeover valve, are secured to a mount plate 19 and have spools 17, 18, respectively, which are positioned vertically. The mount plate 19 is secured to a bracket 22 on the mast 5 by a bolt 20 and spacer 21.

Above the control valves 15, 16, a control box 23 is secured to the mount plate 19. Housed in the control box 23 is an interlocking assembly 24 for rendering the control valves 15, 16 operable independently of each other and also at the same time by the single control lever 14.

The interlocking assembly 24 comprises a first pivot 25 and a second pivot 26 having axes intersecting each other at right angles, a first pivotal element 27 movable about the axis of the first pivot 25, and a second pivotal element 28 movable about the axis of the second pivot 26. The control lever 14 is secured to the second pivotal element 28. The control lever 14 extends upward through an opening 30 formed in the top plate 29 of the control box 23.

The first pivotal element 27, which is generally U-shaped when seen from above, has the first pivot 25 attached to the right side thereof, with the axis of the pivot extending laterally. The first pivot 25 is rotatably inserted through a boss portion 31 secured to the mount plate 19. The first pivotal element 27 has a rearwardly projecting arm 32, which is connected to the spool 17 of the boom control valve 15 by a pin 33, rod 34 and pin 35.

The second pivotal element 28 is surrounded by the first pivotal element 27 and rotatably supported by the second pivot 26 having its axis positioned in the front-to-rear direction. The second pivot 26 is supported by the first pivotal element 27. The second pivotal element 28 has on its left side a projection 36 coaxial with the first pivot 25. The projection 36 is connected to the spool 18 of the implement control valve 16 by a ball socket 36A, rod 37 and pin 38.

Because of the foregoing construction, the control lever 14 is pivotally movable forward and rearward about the first pivot 25 to move the spool 17 of the boom control valve 15 therewith. The forward movement lowers the boom 7, while the rearward movement raises the boom 7.

The control lever 14 is further movable leftward and rightward about the second pivot 26 to move the spool 18 of the implement control valve 16 therewith. The leftward movement moves the work implement 9 in a scooping direction (direction of arrow X in FIG. 4), while the rightward movement moves the implement 9 in a dumping direction (direction of arrow Y in FIG. 4).

The control lever 14 is pivotally movable in a direction intermediate between the forward or rearward direction and the leftward or rightward direction by rotating the first pivotal element 27 about the first pivot 25 and also rotating the second pivotal element 28 about the second pivot 26. The movement in the intermediate direction moves the spools 17, 18 of the two control valves 15, 16, whereby the boom 7 and the implement 9 can be moved at the same time.

The control lever 14 has an engaging portion 39 projecting leftward from its base portion and having a left end positioned slightly forward from its base right end. The lower portion of the left end serves as a hook 39A.

The top plate 29 of the control box 23 is provided with an engagable member 40 with which the hook 39A of the engaging portion 39 is releasably engagable.

Figure 6:
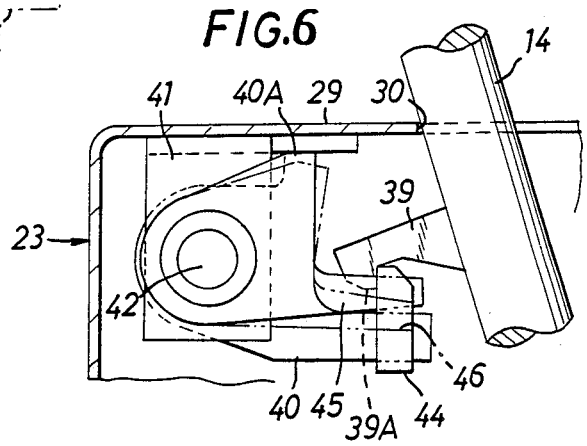
FIG. 6 and FIG. 7 are views illustrating the movement of the portion and the member for engagement.
Figure 7:
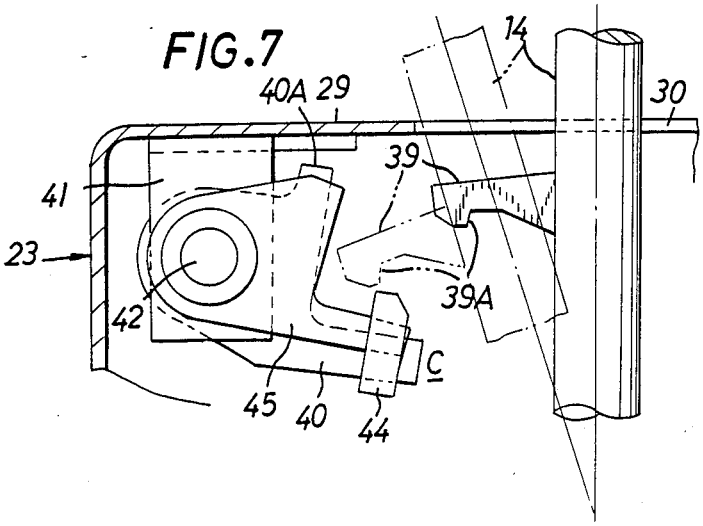

The control box top plate 29 has an inverted U-shaped bracket 41 attached to its lower side and supporting the engagable member 40 on a pivot 42 upwardly and downwardly movably. The member 40 has a stopper portion 40A and is biased upward by a coiled spring 43 to hold the stopper portion 40A in bearing contact with the top plate 29 (see FIGS. 6 and 7).

Figure 10:
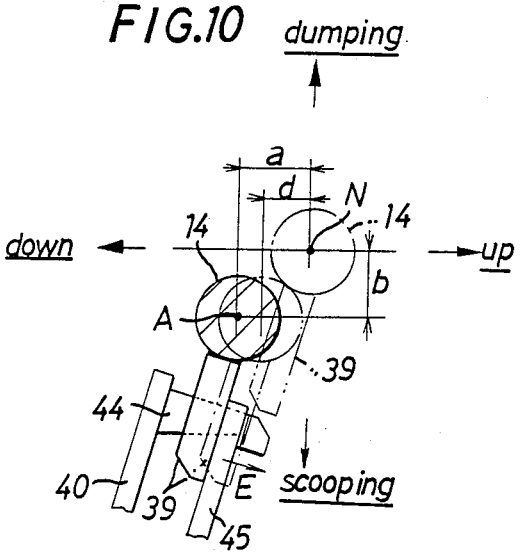
FIG. 10 is a diagram for illustrating the operation of a control lever.

The engagable member 40 has a rearward projection 44 at its forward end. When the control lever 14 is shifted forward from its neutral position N by a distance a and thereby positioned for lowering the boom-7 and is also shifted leftward by a distance b and thereby positioned for the scooping movement of the work implement as seen in FIG. 10, the engaging portion 39 engages with the projection 44 from above. The lever 14 thus positioned is indicated at A in FIG. 10. The engagement restrains the control lever 14 from being moved rightward by a spring (not shown) for returning the spool 18 to its neutral position.

The engaging portion 39 as engaged with the projection 44 is slidable rearward (as indicated by arrow E in FIG. 10). When in the position A, the control lever 14 is restrained by a stopper 45 from moving in the direction of arrow E.

Figure 5:
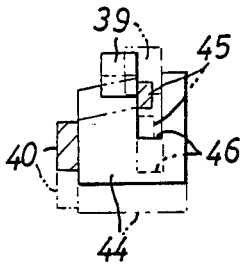
FIG. 5 is a sectional view showing an engaging portion and an engagable member.

As seen in FIG. 5, the stopper 45 is so disposed as to position its forward end in a cutout 46 formed in the projection 44 and is secured at its base portion to the rear end of the pivot 42. The pivot is fixedly provided at its front end with a link 47, which is connected by a connector 48 to a link 50 secured to a lateral rod 49.

The lateral rod 49 is rotatably supported by a boss portion 52 secured to a side plate 51 of the control box 23. The rod 49 fixedly carries a link 53 which is L-shaped when seen from the front or rear. A release lever 55 for use in an emergency is projected rearward through the rear side wall 54 of the control box 23 and is supported at its base portion by the rod 49 upwardly and downwardly movably. The release lever 55 has a pin 56 inserted in a slot 57 in the link 53.

The release lever 55 is biased upward by a spring 58. The rear side plate 54 of the control box 23 is formed with a vertical slot 59 for the release lever 55 to extend therethrough. At the lower end of the slot 59, the rear side plate 54 has a recessed portion 60 for the release lever 55 to engage in, whereby the lever is held in a released position.

With reference to FIG. 1, boom sensor means 61 detects the position of the boom 7 which is movable upward and downward by the boom cylinder 10 about the pivot 6 on the mast 5. Interlocking means 61A causes the stopper 45 to move down the engagable member 40 to a released position C.

Figure 11:
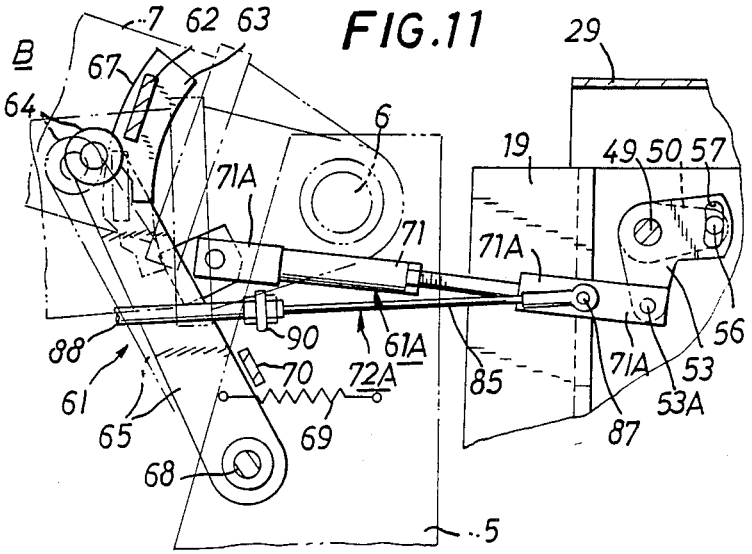
FIG. 11 is a view for illustrating the operation of boom sensor means.

More specifically, when the boom 7 is brought to a transport position B indicated in phantom line in FIGS. 4 and 11, the stopper 45 is drawn into the cutout 46 to free the engaging portion 39. When the boom 7 is brought to a level lower than the transport position B, the stopper 45 moves down the engagable member 40 to the released position C (see FIG. 7).

The boom sensor means 61 comprises a cam plate 63 attached by a bracket 62 to the base portion of the right boom 7 on its inner side, and a sensor arm 65 having a cam follower roller 64 for the cam plate 63. The cam plate 63 resembles a circular arc centered about the pivot 6 and has a first cam portion 66 and a second cam portion 67 which are in a stepwise arrangement. The sensor arm 65 is movably supported by a pivot 68 on the mast 5, biased by a spring 69 to hold the cam follower roller 64 in contact with the cam plate 63 and restrained by a stopper 70. The interlocking means 61A comprises a rod 71 having a bifurcated member 71A at each end and made adjustable in length by a turnbuckle structure. The sensor arm 65 is connected to the link 53 on the lateral rod 49 by the rod 71 and a pin 53A. Accordingly, the sensor arm 65, when moved about the pivot 68, causes the pivot 42 to rotate the stopper 45 upward or downward about its axis through the rod 71, link 53, lateral rod 49, link 50, connector 48 and link 47. The engaging portion 39 is not engagable with the projection 44 of the engagable member 40 when the member 40 is in the released position C.

Figure 8:
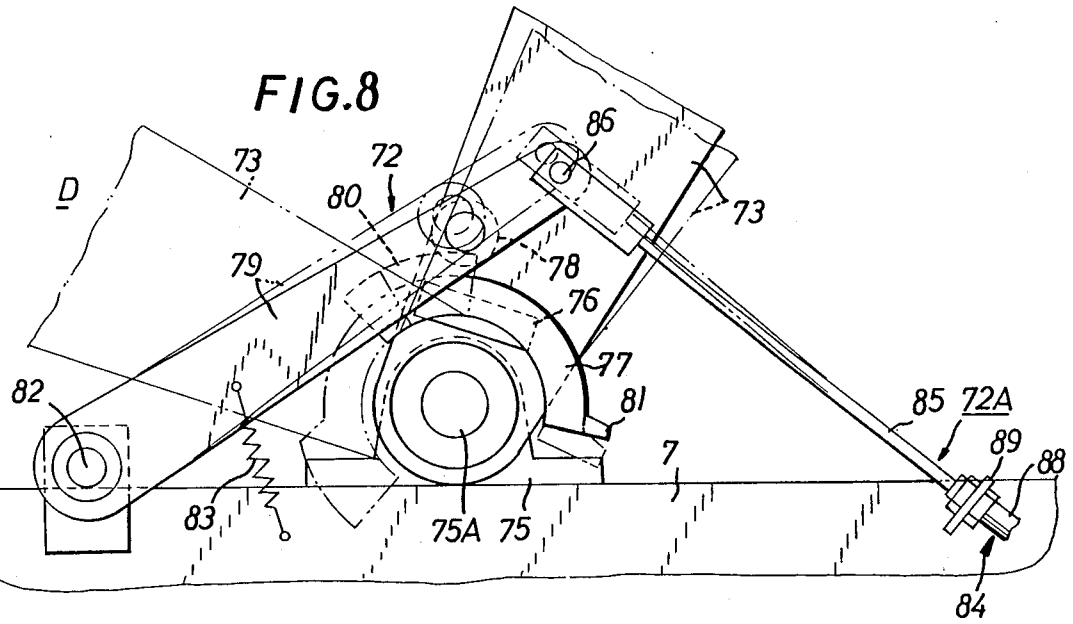
FIG. 8 is a side elevation of implement sensor means.
Figure 9:
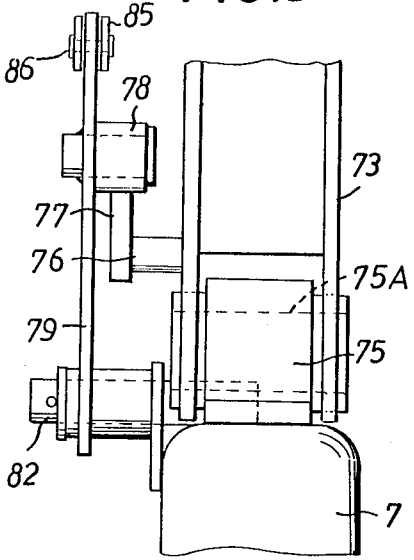
FIG. 9 is a rear view of the same.

FIGS. 8 and 9 show sensor means 72 for the work implement 9 which is movable for scooping and dumping, and interlocking means 72 for transmitting the movement of the sensor means 72 to the stopper 45.

The implement sensor means 72 detects the angle of the work implement 9 with respect to the boom 7 to cause the interlocking means 72A to move the stopper 45. The stopper 45 moves down the engagable member 40 to the released position C when the angle of the implement 9 with the boom 7 has become an angle of contact of the implement with the horizontal ground and when the implement has almost completed its dumping movement. With reference to FIG. 4, the work implement 9 is pivoted to the forward end of each boom 7 and pivotally movable by the implement cylinder 11 through a link 73 and a rod 74. The implement sensor means 72 is provided between the link 73 and the boom 7. The link 73 is movably supported by a pivot 75A on a bearing 75 on the boom 7.

As seen in FIGS. 8 and 9, the implement sensor means 72 comprises a cam plate 77 attached by a bracket 76 to the base portion of the right link 73 on the inner side thereof, and a sensor arm 79 having a follower roller 78 for the cam plate 77.

The cam plate 77 resembles a circular arc centered about the pivot 75A and has a first cam portion 80 and a second cam portion 81 at its respective ends. The sensor arm 79 is movably supported by a pivot 82 which is fixed to the boom 7 and closer to its forward end than the pivot 75A. The arm 79 is so biased by a spring 83 as to hold the roller 78 in contact with the cam plate 77.

A push-pull cable 84 has an inner wire 85 one end of which is connected to the free end of the sensor arm 79 by a pin 86. The other end of the wire 85 is connected to the bifurcated member 71A of the rod 71 by a pin 87.

The push-pull cable 84 includes an outer wire 88 having one end attached to a holder 89 secured to the boom 7 and the other end attached to a holder 90 which is secured to the mast 5 and positioned above the pivot 68 as seen in FIG. 1. The portion of the inner wire 85 toward the other end thereof extends approximately in parallel to the rod 71.

The cam portions 80 and 81 of the cam plate 77 pivotally move the sensor arm 79 through the follower roller 78. The first cam portion 80 pushes the sensor arm 79 for pivotal movement when the work implement 9 is positioned at the angle of contact. The second cam portion 81 pushes and pivotally moves the arm 79 to pivotally move the implement 9 over an angular range of about 10 degrees when the implement is brought close to the position where the implement completes its dumping action.

The operation of the present apparatus will be described next. When the control lever 14 is shifted toward the dumping direction with the boom in its uppermost position U shown in FIG. 4, the second pivotal element 28 moves about the second pivot 26, causing the projection 36 and the rod 37 to pull up the spool 18 of the implement control valve 16. Consequently, the implement cylinder 11 extends, moving the implement 9 about the pivot 8 to dump sand or earth. When the cylinder 11 is extended almost to the position of completion of dumping at this time, the link 73 is located in the phantom-line position D in FIG. 8, so that the second cam portion 81 of the cam plate 77 of the implement sensor means 72 causes the follower roller 78 to push the sensor arm 79. The interlocking means 72A comprising the push-pull cable 84, pin 86, link 53, lateral rod 49, link 50, connector 48, link 47, etc. therefore moves the stopper 45 downward about the pivot 42, thereby moving down the engagable member 40 to the released position C in FIG. 7.

Accordingly, if the control lever 14 is shifted leftward and rightward in the dumping and scooping directions after dumping the earth to extend and contract the implement cylinder 11, the implement 9 repeatedly performs the dumping and scooping movements. The remaining portion of earth adhering to the implement 9 can therefore be removed by the resulting vibration. At this time, the implement 9 moves through an angle of about 10 degrees with the follower roller 78 remaining in contact with the second cam portion 81 to hold the engagable member 40 in the released position C. Thus, the engaging portion 39 of the control lever 14 is held out of engagement with the projection 44 of the engagable member 40.

With the work implement 9 in the dumping position, the control lever 14 is shifted toward the lowering direction to the lowering position from the neutral position N by a distance a, is also shifted toward the scooping direction to the scooping position by a distance b and is thereby set in a lowering-scooping position A as shown in FIG. 10, whereby the engaging portion 39 is engaged with the projection 44 of the engagable member 14 from above to lock the control lever 14 in the lowering-scooping position A.

More specifically stated, the shift of the control lever 14 in the lowering direction moves the first pivotal element 27 about the first pivot 25, causing the arm 32 and rod 34 to pull up the spool 17 of the boom control valve 15, which in turn contracts the boom cylinder 9 to lower the boom 7 about the pivot 6. On the other hand, the shift of the control lever 14 in the scooping direction moves the second pivotal element 28 about the second pivot 26, causing the rod 37 to push down the spool 18 of the implement control valve 16, which in turn contracts the implement cylinder 11 to move the implement 9 upward about the pivot 8 for scooping as indicated by arrow X.

Thus, the boom 7 is lowered simultaneously with the scooping movement of the work implement 9. With the start of the scooping movement of the implement 9, on the other hand, the follower roller 78 is released from the second cam portion 81 of the cam plate 77 of the implement sensor means 72, permitting the sensor arm 79 to return under the action of the spring 83. This movement is delivered to the interlocking means 72A, permitting the spring 43 to move the engagable member 40 upward. Consequently, the projection 44 of the engagable member 40 is brought into engagement with the engaging portion 39 as indicated in solid line in FIG. 6 to lock the control lever 14 in the lowering-scooping position A. At this time, the engaging portion 39 is restrained in the solid-line state in FIG. 10 by the stopper 45.

Upon the boom 7 reaching the transport position B during the descent, the first cam portion 66 of the cam plate 63 of the boom sensor means 61 causes the cam follower roller 64 to move the sensor arm 65 as indicated in solid line in FIG. 11. The interlocking means 61A comprising the rod 71, link 53, etc. therefore moves the stopper 45 downward into the cutout 46 of the projection 44, releasing the engaging portion 39 from the restraint.

The return springs incorporated in the respective control valves 15, 16 exert a force on the control lever 14 through the spools 17, 18, acting to return the lever 14 toward its neutral position N. When the stopper 45 is moved down, accordingly, the return spring of the boom control valve 15 pushes back the control lever 14, so that the engaging portion 39 as engaged with the projection 44 of the member 40 slides in the direction of arrow E in FIG. 10. This returns the control lever 14 toward the lifting direction into a range of play, d. The spool 17 of the boom control valve 15 thus returns to its neutral position to halt the boom 7 in the transport position B.

On the other hand, when the work implement 9 moves from the dumping posture in the scooping direction and is brought to a position at the angle of contact with the horizontal ground, the first cam portion 80 of the cam plate 77 of the implement sensor means 72 moves the sensor arm 79, causing the interlocking means 72A including the push-pull cable 84, etc. to move down the stopper 45, thereby lowering the engagable member 40 to the released position C.

Consequently, the engaging portion 39 is released from the projection 44 of the engagable member 40, whereupon the spool 18 of the implement control valve 16 is returned to its neutral position by the return spring thereof. The implement 9 therefore stops, and the control lever 14 returns to the neutral position.

When the implement 9 is positioned at the angle of contact through a small amount of scooping movement, the boom 7 stops during its descent before reaching the the transport position B since the implement sensor means 72 functions to lower the engagable member 40 to the released position C. Accordingly, the boom 7 and the work implement 9 invariably stop when the work implement 9 is positioned at the angle of contact.

Next, when the control lever 14 is shifted toward the lowering direction, the first pivotal element 27 moves about the first pivot 25, causing the arm 32 and the rod 34 to pull up the spool 17 of the boom control valve 15, which in turn contracts the boom cylinder 10 to lower the boom 7. During this movement, the implement 9 remains at the contact angle and can therefore be brought into contact with the ground invariably with its boom 9A positioned horizontally when lowered.

When the boom 7 is lowered to a level below the transport position B, the second cam portion 81 of the cam plate 77 of the implement sensor means 72 pushes the sensor arm 79, so that the engagable member 40 is located in the released position C. Accordingly, even if the implement 9 is at an angle other than the contact angle, the engaging portion will not engage with the projection 44 of the engagable member 40.

When the work implement 9 is to be merely moved for scooping, the control lever 14 is shifted directly toward the scooping direction from the neutral position N. Since the projection 44 is in the forward position at this time, the engaging portion 39 remains out of contact with the projection 44 of the engagable member 40.

What is claimed is:

1. An apparatus for controlling the posture of a front loader having a mast secured to a vehicle body, a boom supported by the mast and liftable by a boom cylinder, a work implement rotatably supported by the forward end of the boom and movable by an implement cylinder for scooping and dumping, a boom control valve for operating the boom cylinder, an implement control valve for operating the implement cylinder, and a single control lever for operating the two control valves independently of each other and also at the same time, the apparatus being characterized in that it comprises an engaging portion provided on the control lever, an engagable member provided on a fixed member on the vehicle body and releasably engagable with the engaging portion when the control lever is positioned for lowering the boom and moving the work implement for scooping, implement sensor means for detecting whether an angle between the work implement and boom is an angle which would make the work implement bottom surface parallel with the horizontal ground when the boom is lowered to a height where the work implement would contact the ground, and release interlocking means operatively connected to the implement sensor means and to the engagable member for moving the engagable member to a released position where the engagable member is not engagable with the engaging portion upon the implement sensor means detecting said angle.

2. An apparatus as defined in claim 1 wherein the implement sensor means comprises a link supported by a pivot on the boom and movable forward and rearward for transmitting the operation of the implement cylinder to the work implement for scooping and dumping, and a sensor arm supported by the boom in proximity to the link and pivotally movable forward and rearward, the link being provided with a circular-arc cam plate centered about the pivot, the sensor arm being provided with a cam follower roller in contact with the cam plate.

3. An apparatus as defined in claim 2 wherein the release interlocking means comprises a push-pull cable including an inner wire, and the inner wire has one end connected to the sensor arm and the other end connected to the engagable member.

4. An apparatus as defined in claim 1 wherein a control box is provided on the fixed member, and the boom control valve and the implement control valve are housed in the control box, the control box further having accommodated therein a first pivotal element movably supported on a first pivot for operating the boom control valve, and a second pivotal element movably supported on a second pivot for operating the implement control valve, the second pivot having an axis intersecting the axis of the first pivot at right angles therewith, the control lever being attached to the second pivotal element.

5. An apparatus as defined in claim 1 wherein a control box is provided on the fixed member, and the boom control valve and the implement control valve are housed in the control box, the control box further having accommodated therein a first pivotal element movably supported on a first pivot for operating the boom control valve, and a second pivotal element movably supported on a second pivot for operating the implement control valve, the second pivot having an axis intersecting the axis of the first pivot at right angles therewith, the control lever being attached to the second pivotal element, the control box having therein a pivot rod supported by a bracket, the pivot rod being provided with the engagable member biased by a spring and having an engagement portion.

6. An apparatus as defined in claim 5 wherein the engagable member having the engagement portion and a stopper is mounted on the pivot rod.

7. An apparatus for controlling the posture of a front loader having a mast secured to a vehicle body, a boom supported by the mast and liftable by a boom cylinder, a work implement rotatably supported by the forward end of the boom and movable by an implement cylinder for scooping and dumping, a boom control valve for operating the boom cylinder, an implement control valve for operating the implement cylinder, and a single control lever for operating the two control valves independently of each other and also at the same time, the apparatus being characterized in that is comprises an engaging portion provided on the control lever, an engagable member provided on a fixed member on the vehicle body and releasably engagable with the engaging portion when the control lever is positioned for lowering the boom and moving the work implement for scooping, implement sensor means for detecting whether an angle between the work implement and boom is a first angle which would make the work implement bottom surface parallel with the horizontal ground when the boom is lowered to a height where the work implement would contact the ground, and for detecting whether an angle between the work implement and the boom is a dumping angle at which the work implement almost completes its dumping movement, and release interlocking means operatively connected to the implement sensor means and to the engagable member for moving the engagable member to a released position where the engagable member is not engagable with the engaging portion upon the implement sensor means detecting said first angle and the dumping angle.

8. An apparatus as defined in claim 7 wherein the implement sensor means comprises a link supported by a pivot on the boom and movable forward and rearward for transmitting the operation of the implement cylinder to the work implement for scooping and dumping, and a sensor arm supported by the boom in proximity to the link and pivotally movable forward and rearward, the link being provided with a circular-arc cam plate centered about the pivot, the sensor arm being provided with a cam follower roller in contact with the cam plate.

9. An apparatus as defined in claim 8 wherein the release interlocking means comprises a push-pull cable including an inner wire, and the inner wire has one end connected to the sensor arm and the other end connected to the engagable member.

10. An apparatus as defined in claim 7 wherein a control box is provided on the fixed member, and the boom control valve and the implement control valve are housed in the control box, the control box further having accommodated therein a first pivotal element movably supported on a first pivot for operating the boom control valve, and a second pivotal element movably supported on a second pivot for operating the implement control valve, the second pivot having an axis intersecting the axis of the first pivot at right angles therewith, the control lever being attached to the second pivotal element.

11. An apparatus for controlling the posture of a front loader having a mast secured to a vehicle body, a boom supported by the mast and liftable by a boom cylinder, a work implement rotatably supported by the forward end of the boom and movable by an implement cylinder for scooping and dumping, a boom control valve for operating the boom cylinder, an implement control valve for operating the implement cylinder, and a single control lever for operating the two control valves independently of each other and also at the same time, the apparatus being characterized in that it comprises an engaging portion provided on the control lever, an member provided on a fixed member on the vehicle body and releasably engagable with the engaging portion when the control lever is positioned for lowering the boom and moving the work implement for scooping, a stopper movably provided on the fixed member for restraining the engaging portion in engagement with the engagable member from moving toward a neutral position, boom sensor means for detecting whether the boom is in a transport position, release interlock means for releasing the stopper when the boom is in the transport position and for causing the stopper to move the engagable member to a released position where the engagable member is not engagable with the engaging portion when the boom is positioned below the transport position, implement sensor means for detecting whether an angle between the work implement and the boom is an angle which would make the work implement bottom surface parallel with the horizontal ground when the boom is lowered to a height where the work implement would contact the ground, and release interlocking means for causing the stopper to move the engagable member to the released position upon the implement sensor means detecting said angle.

12. An apparatus as defined in claim 11 wherein the implement sensor means comprises a link supported by a pivot on the boom and movable forward and rearward for transmitting the operation of the implement cylinder to the work implement for scooping and dumping, and a sensor arm supported by the boom in proximity to the link and pivotally movable forward and rearward, the link being provided with a circular arc cam plate centered about the pivot, the sensor arm being provided with a cam follower roller in contact with the cam plate.

13. An apparatus as defined in claim 12 wherein the release interlocking means comprises a push-pull cable including an inner wire, and the inner wire has one end connected to the sensor arm and the other end connected to the engagable member.

14. An apparatus as defined in claim 11 wherein the boom sensor means comprises a cam plate attached to a base portion of the boom liftably supported by a pivot on the mast, and a sensor arm having a cam follower roller in contact with the cam plate, the sensor arm being supported by the mast and pivotally movable forward and rearward, the release interlock means being provided on the sensor arm and comprising a rod adjustable in length with a screw.

15. An apparatus as defined in claim 13 wherein the boom sensor means comprises a cam plate attached to the base portion of the boom liftably supported by a pivot on the mast, and a sensor arm having a cam follower roller in contact with the cam plate, the sensor arm being supported by the mast and pivotally movable forward and rearward, the release interlock means being provided on the sensor arm and comprising a rod adjustable in length with a screw, and 14 wherein the other end of the inner wire of the release interlocking means for the implement sensor means is connected to the release interlock means comprising the length-adjustable rod and provided for the boom sensor means.

16. An apparatus as defined in claim 11 wherein a control box is provided on the fixed member, and the boom control valve and the implement control valve are housed in the control box, the control box further having accommodated therein a first pivotal element movably supported on a first pivot for operating the boom control valve, and a second pivotal element movably supported on a second pivot for operating the implement control valve, the second pivot having an axis intersecting the axis of the first pivot at right angles therewith, the control lever being attached to the second pivotal element.

* * * * *